United States Patent [19]

Nakazawa et al.

[11] 3,960,798

[45] June 1, 1976

[54] PROCESS FOR REGULATING HARDENING SPEED OF SELF-HARDENING MOLD

[75] Inventors: Tetsuo Nakazawa, Tokyo; Osamu Nishida, Saitama, both of Japan

[73] Assignee: Hitachi, Ltd., Japan

[22] Filed: Aug. 26, 1974

[21] Appl. No.: 500,693

[52] U.S. Cl. ..... 260/29.6 BM; 260/29.6 BE; 260/33.4 R; 260/42.51

[51] Int. Cl.[2] ..... C08L 29/00

[58] Field of Search ..... 260/42.51, 42.29, DIG. 40, 260/91.3 VA, 29.6 BM, 29.6 BE; 164/43

[56] References Cited

UNITED STATES PATENTS

| | | | |
|---|---|---|---|
| 3,219,613 | 11/1965 | Keene | 260/42.51 X |
| 3,324,065 | 6/1967 | Pierce | 260/42.51 X |
| 3,591,543 | 7/1971 | Stafford | 260/91.3 VA X |
| 3,632,786 | 1/1972 | Nickerson | 260/29.6 BM |
| 3,886,112 | 5/1975 | Watson et al. | 260/33.4 R |

*Primary Examiner*—Lewis T. Jacobs
*Attorney, Agent, or Firm*—Craig & Antonelli

[57] ABSTRACT

A process for regulating the hardening speed of a self-hardening mold which comprises adding an alcohol as a hardening speed regulating agent when a mold is formed with molding sand prepared by adding a polyvinyl alcohol solution and a boron compound to refractory particles and then kneading the mixture. As the hardening speed regulating agent, polyhydric alcohol such as ethylene glycol, mannitol, sorbitol, glycerol, etc., and monohydric alcohols such as methyl alcohol, ethyl alcohol, isopropyl alcohol, etc., may be used.

14 Claims, 4 Drawing Figures

BLENDING RATIO:
SILICA SAND ( No. 100 ) 100 PARTS
10% POLYVINYL ALCOHOL SOLUTION 4 PARTS
BORAX 0.5 PART
COMPRESSION STRENGTH AFTER DRYING AT 100°C FOR 2 HOURS
COMPRESSION STRENGTH AFTER STANDING AT ROOM TEMPERATURE FOR 24 HOURS
SURFACE STABILITY AFTER STANDING AT ROOM TEMPERATURE FOR 24 HOURS
COMPRESSION STRENGTH ( kg/cm² )
0
10
20
30
40
50
60
SURFACE STABILITY (%)
95
100
5
10
15
20
25
30
35
CONCENTRATION OF ISOPROPYL ALCOHOL (%)

PROCESS FOR REGULATING HARDENING SPEED OF SELF-HARDENING MOLD

BACKGROUND OF THE INVENTION

The present invention relates to a process for regulating the hardening speed of a self-hardening mold for casting of metals. More particularly, the invention pertains to a process for regulating the hardening speed of a self-hardening mold which comprises adding a hardening speed regulating agent when a mold is formed with molding sand prepared by adding a polyvinyl alcohol solution as a binder and a boron compound as a curing agent to refractory particles and then kneading the mixture. Thus, the bench life of the molding sand can be freely regulated by varying the amount of the hardening speed regulating agent added.

When a complex shape mold is desired to be produced with a self-hardening molding sand (a reasonable bench life is required), or when the production of a mold requires a long period of time for other reasons, it is necessary that the hardening speed of molding sand is slow. In other words, a bench life corresponding to the time for the production of a mold is required for molding sand. Generally speaking, it is desirable that the hardening speed of molding sand can be freely regulated.

SUMMARY OF THE INVENTION

According to the present invention, the hardening speed of a self-hardening mold can be regulated by adding an alcohol when a mold is formed with molding sand prepared by adding a polyvinyl alcohol solution as a binder and a boron compound as a curing agent such as borax, sodium perborate, boric acid, potassium borate, ammonium borate and boron oxide to refractory particles and then kneading the mixture. The alcohol serves to regulate the reaction velocity between the polyvinyl alcohol solution and the boron compound.

Accordingly, an object of the present invention is to provide a process for regulating the hardening speed of a self-hardening mold by which the bench life of the molding sand can be freely regulated.

The invention will be more completely understood by reference to the following detailed description taken in conjunction with the appended drawing.

DETAILED EXPLANATION

Figure 1:
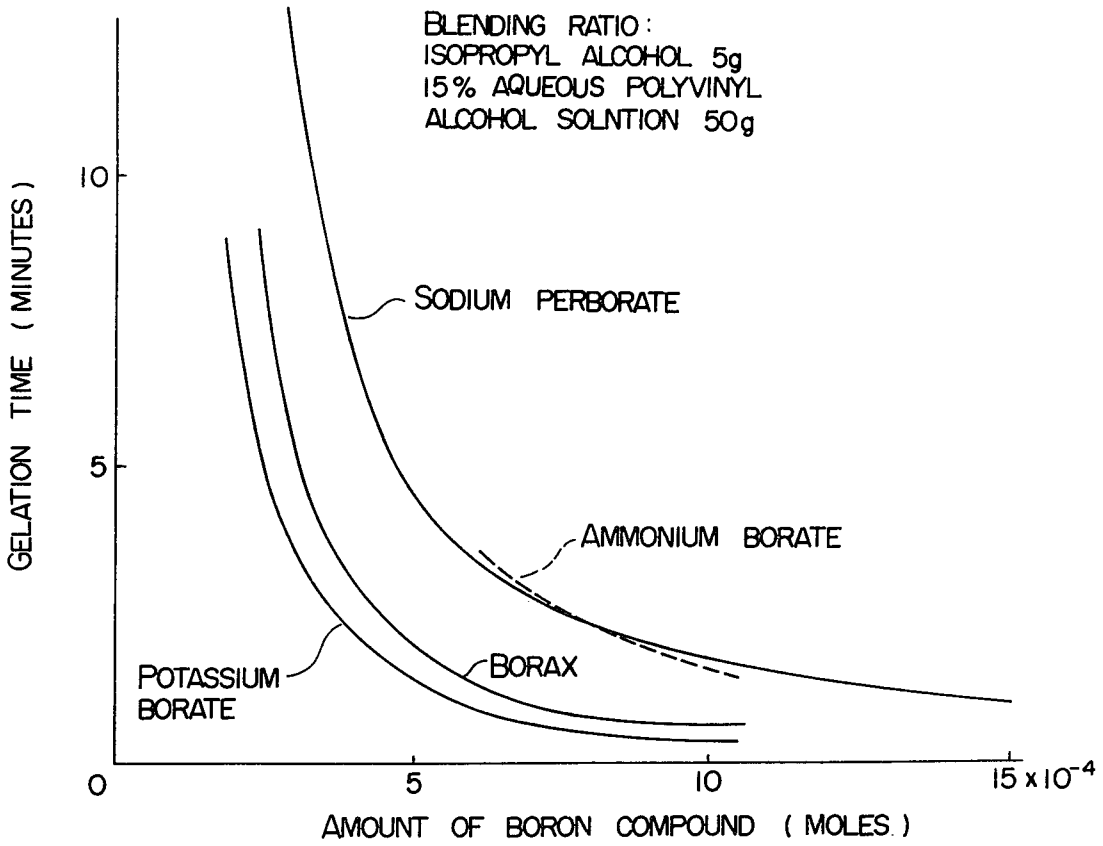
FIG. 1 shows a relationship between an amount of a boron compound added and the gelation time of the binder used in the present invention.

In this invention wherein polyvinyl alcohol is used as a binder and various boron compounds are used as a curing agent, a hardening speed regulating substance is added to regulate the hardening speed of a mold and regulate freely the bench life of the molding sand.

As the hardening speed regulating substance, polyhydric alcohols such as ethylene glycol, mannitol, sorbitol and glycerol and monohydric alcohols such as methyl alcohol, ethyl alcohol and isopropyl alcohol may be used.

The term "the bench life of molding sand" used herein is defined as follows:

In the case of self-hardening molding sand, hardening reaction proceeds with the lapse of time after preparation. Therefore, the properties of the mold vary according to the time elapsed after the preparation of molding sand. Here, a mold having a strength corresponding to at least 80% of the strength of the mold which was formed immediately after the preparation of molding sand and then allowed to stand for a fixed period of time (based on JIS Test Method for Strength of Molding Sand) is regarded as usable. The time lapsed from the preparation of molding sand to the forming of such a usable mold of the minimum acceptable strength is defined as "bench life."

The following examples, in which all parts and percent are expressed by weight, unless otherwise indicated, will serve to illustrate the practice of the invention in more detail.

EXAMPLE 1

To 100 parts of silica sand [JIS (Japanese Industrial Standard) No. 100], 4 parts of a 10% polyvinyl alcohol solution containing 5% of a hardening speed regulating substance and 1 part of borax to prepare molding sand. Test pieces were prepared from the respective molding sands thus obtained according to JIS Test Method for Strength of Molding Sand and their bench life was measured. The results obtained are shown in Table 1 in comparison with the bench life of a control containing no hardening speed regulating substance.

Table 1

| Hardening speed regulating substance | Bench life (minutes) |
|---|---|
| Control (no addition) | 2.5 |
| Sorbitol | 10 |
| Methyl alcohol | 8 |
| Ethylene glycol | 10 |
| Glycerol | 12 |

As is clear from the above table, all of the hardening speed regulating substances could regulate the bench life of molding sand remarkably. Therefore, it was possible to form a mold having a complex shape easily.

EXAMPLE 2

100 Parts of silica sand (JIS No. 100), 4 parts of polyvinyl alcohol (average polymerization degree 500, degree of saponification 88%), 1 part of borax and glycerol were mixed to prepare molding sand. An amount of glycerol used was varied. Test pieces were prepared from the respective molding sands thus obtained and their bench life was measured. The results obtained are shown in Table 2 in comparison with the bench life of control containing no hardening speed regulating substance.

Table 2

| Amount of glycerol added (parts) | Bench life (minutes) |
|---|---|
| Control (no addition) | 2.5 |
| 0.2 | 8.5 |
| 0.4 | 10.0 |
| 0.6 | 14.0 |
| 0.8 | 18.0 |

As is clear from the above table, the bench life of a mold could be elongated by increasing an amount of the hardening speed regulating substance added. In view of the compression strength and workability of the resulting mold, it is desirable that an amount of the hardening speed regulating substance added is 50 parts or less.

EXAMPLE 3

To 5 Grams of isopropyl alcohol were added different amounts of a boron compound (sodium perborate, ammonium borate, potassium borate or borax) and the mixture was kneaded by a magnet stirrer for 1 minute. 50 Grams of a 15% aqueous solution of polyvinyl alcohol (average polymerization degree 500, degree of saponification 88%) was added and the mixture was kneaded at room temperature. The time required for the gelation of the binder was then measured. The results obtained are shown in FIG. 1.

As is clear from FIG. 1, the gelation time decreased with an increase in the amount of a boron compound added.

Example 2 shows that the hardening reaction can be suitably regulated by the addition of a hardening speed regulating substance when a mold is produced. Example 3 shows that the hardening reaction can also be regulated by varying the amount of a boron compound added. Thus, the time for producing a mold can be widely varied and thereby a complex shape mold can be easily produced.

The binders used in the present invention are hardened after a definite period of time. In this case, the following gelation reaction probably occurs if boric acid is used as a curing agent:

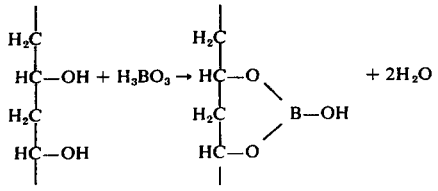

However, the reason why the addition of a hardening speed regulating substance permits the regulation of hardening speed is not clear.

Since said binders contain an organic substance, the collapsibility of the resulting mold after pouring of metal is excellent. Also, owing to the use of polyvinyl alcohol, the resulting mold has less resistance to shrinkage of the casting on solidification and there is little possibility of cracks occurring in the casting. Further, when the solvent for the polyvinyl alcohol solution is a mixture of water and an alcohol as well as water alone, neither poisonous substances nor bad-smelling substance are generated on molding.

The compression strength, surface stability and residual compression strength of the molds produced with the binders are explained below referring to Examples.

EXAMPLE 4

100 Parts of silica sand (JIS No. 100), 4 parts of an aqueous solution of polyvinyl alcohol (degree of saponification 98 or 88%) and 0.5 part of borax were mixed to prepare molding sand. Test pieces were prepared and their compression strengths after standing at room temperature for 2 hours and after standing at the temperature for 24 hours were measured. The results obtained are shown in Table 3.

Table 3

| Binder | | | | Compression strength ($kg/cm^2$) | |
|---|---|---|---|---|---|
| Degree of polymerization | Degree of saponification (%) | Concentration (%) | Viscosity (c.p.) | After 2 hours | After 24 hours |
| 500 | | | 60 | 3.0 | 15.8 |
| 1700 | 98 | | 1000 | 3.5 | 14.5 |
| 2400 | | 10 | 6000 | 3.8 | 16.2 |
| 500 | | | 30 | 4.2 | 14.0 |
| 1700 | 88 | | 600 | 4.8 | 15.2 |
| 2400 | | | 2000 | 4.6 | 13.2 |

As is clear from the above table, these molding sands had sufficient compression strength as a mold. Also, it is seen that their compression strength varies according to the polymerization degree or saponification degree of polyvinyl alcohol. The hardening speed of the molding sands was affected by the saponification degree of polyvinyl alcohol and the molding sand produced with a binder having a lower degree of saponification was hardened slightly more rapidly. Thus, the best mold can be obtained by selecting the specific binder used according to use and conditions for the fabrication of the mold.

EXAMPLE 5

In the same blending ratio as in Example 4, the concentration of an aqueous solution of polyvinyl alcohol (average polymerization degree 500, degree of saponification 88%) was widely varied, and the compression strength and surface stability (a ratio of the weight of a test piece before the test to the weight of the test piece after the test when the test piece was placed on a 10 mesh sieve and then vibrated by a vibrator for 2 minutes) of the resulting molding sands were measured. The results obtained are shown in FIG. 2.

Figure 2:
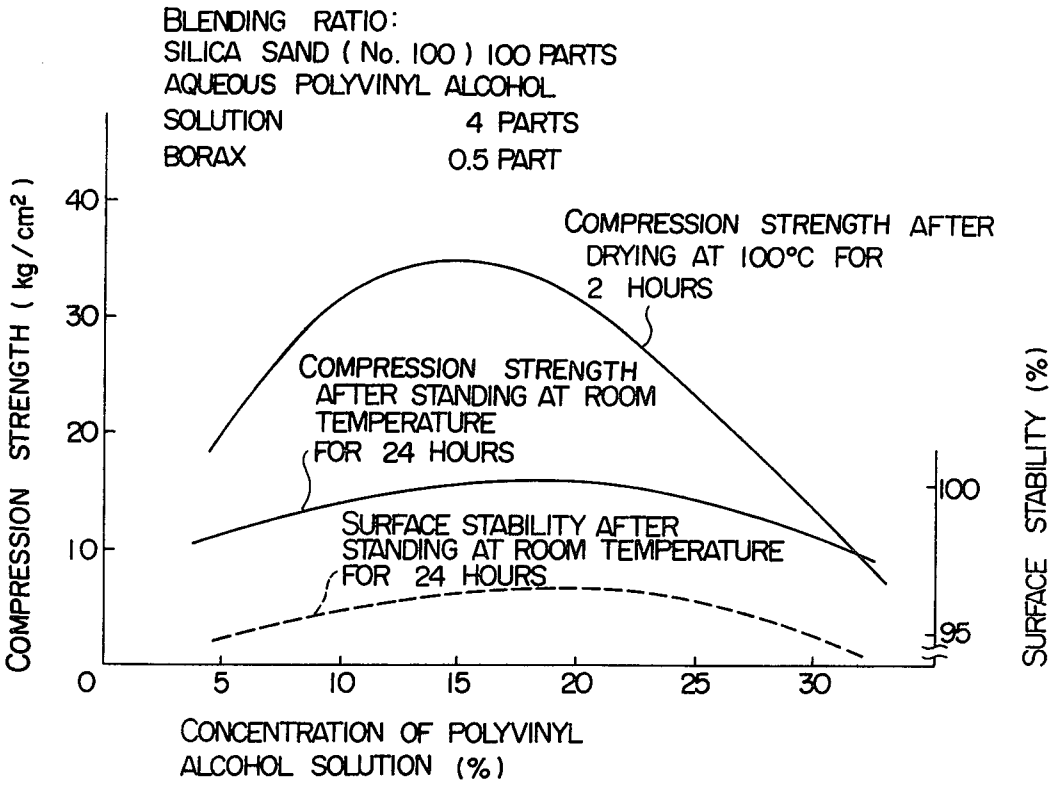
FIG. 2 shows a relationship between the concentration of a polyvinyl alcohol solution and the compression strength or surface stability of the mold obtained by the process of the present invention.

In FIG. 2, compression strength ($kg/cm^2$) and surface stability (%) were plotted along Y-axis and the concentration of a polyvinyl alcohol solution was plotted along X-axis. Compression strength is shown by a solid line while surface stability is shown by a broken line.

As is clear from FIG. 2, values of compression strength after standing at room temperature for 24 hours were good at a solution concentration of 5% or more. When the test pieces were dried at 100°C for 2 hours, that is, were subjected to forced drying, the compression strength of the test pieces was remarkably improved and this tendency was stronger at a lower concentration. As a surface stability of about 95% is satisfactory for general use of a mold, surface stability values were good at a solution concentration of 5 to 30%.

EXAMPLE 6

Water used in Example 5 as a solvent for polyvinyl alcohol was replaced by a mixture of water and isopropyl alcohol. The concentration of polyvinyl alcohol was maintained at 10% and the concentration of isopropyl alcohol was varied widely. The compression strength and surface stability of the resulting molds were measured. The results obtained are shown in FIG. 3.

Figure 3:
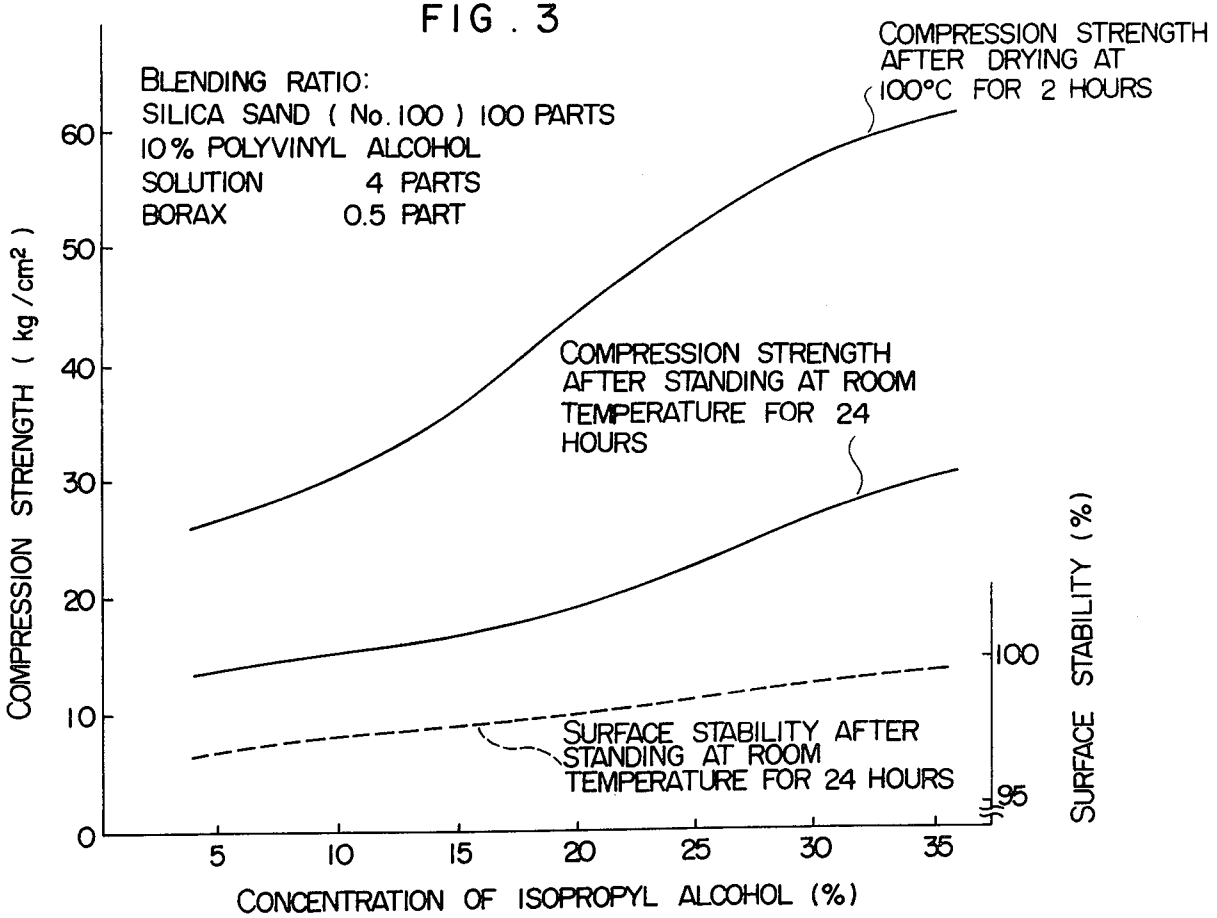
FIG. 3 shows a relationship between the concentration of isopropyl alcohol and the compression strength and surface stability of the mold obtained by the process of the present invention.

As is clear from FIG. 3, compression strength and surface stability increased with an increase in isopropyl alcohol concentration.

EXAMPLE 7

Molding sands were prepared by adding different amounts of a boron compound (borax, sodium perborate or manganese borate) to a mixture of 100 parts of silica sand (JIS No. 100) and 5 parts of a 15% solution of polyvinyl alcohol (average polymerization degree 500, degree of saponification 88%) consisting of 15% of polyvinyl alcohol, 60% of water and 25% of isopropyl alcohol. Compression strength after standing at room temperature for 24 hours of a test piece prepared from each molding sand was measured. The results obtained are shown in FIG. 4.

Figure 4:
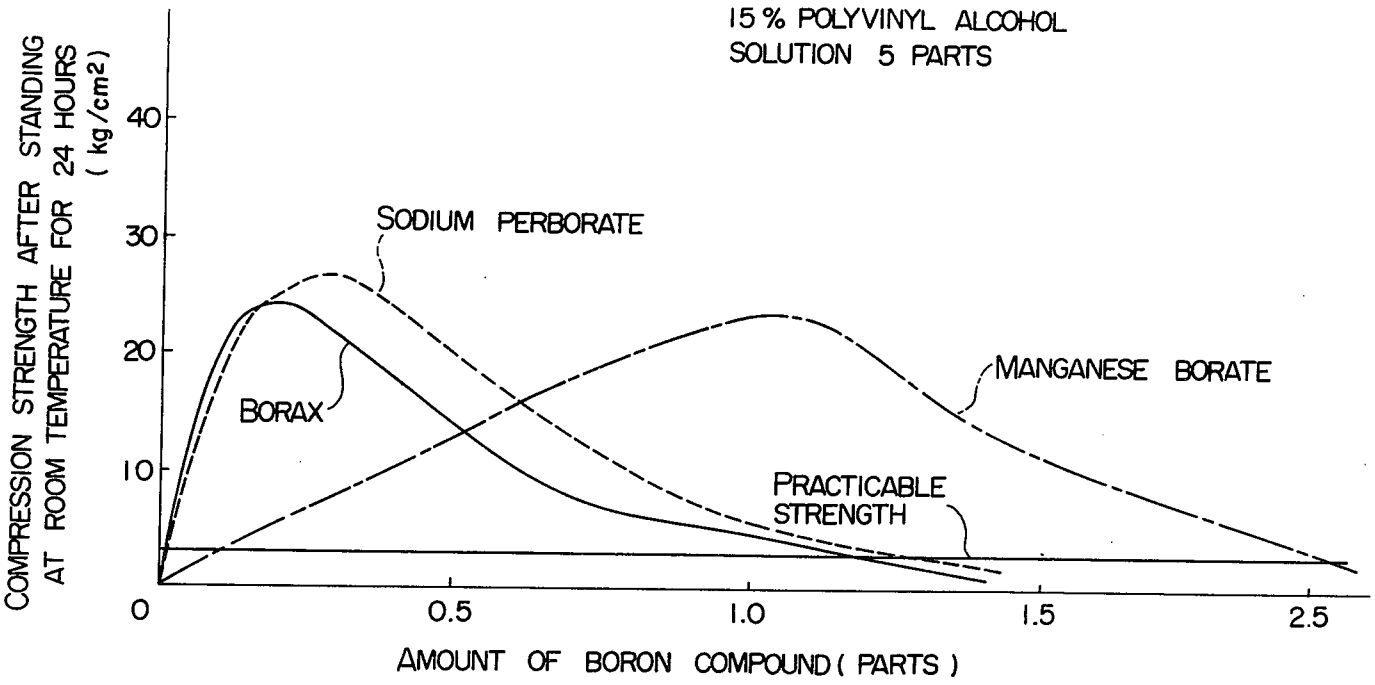
FIG. 4 shows a relationship between an amount of a boron compound added and the compression strength of the mold obtained by the process of the present invention.

As is clear from FIG. 4, the compression strength of the resulting mold varied according to the amount of a boron compound added, and also widely varied according to the kind of the boron compound used. Borax and sodium perborate showed almost the same action as a curing agent for polyvinyl alcohol. The addition of 0.01 to 1.3 parts of the compounds was effective for obtaining a practicable strength (compressing strength 3 kg/cm$^2$ or more). Potassium borate, boron oxide and ammonium borate belong in this category. Manganese borate can be effectively used in an amount of 0.1 to 2.1 parts. Boric acid, magnesium borate and calcium borate belong in this category.

EXAMPLE 8

A test piece was prepared by mixing 100 parts of silica sand (JIS No. 100), 4 parts of a 10% aqueous solution of polyvinyl alcohol (average polymerization degree 500, degree of saponification 88%) and 0.5 part of a boron compound (ammonium borate, boron oxide or boric acid), and its compression strength was measured. The results obtained are shown in Table 4.

Table 4

| Boron compound | Compression strength (kg/cm$^2$) After 2 hours | After 24 hours |
|---|---|---|
| Ammonium borate | 3.0 | 10.2 |
| Boron oxide | 6.0 | 16.3 |

Table 4-continued

| Boron compound | Compression strength (kg/cm$^2$) After 2 hours | After 24 hours |
|---|---|---|
| Boric acid | 1.2 | 10.3 |

As is clear from the above table, all of these test pieces had a sufficient strength as a mold.

EXAMPLE 9

In order to compare the collapsibility of a prior art $CO_2$ mold using sodium silicate as a binder with that of a mold produced by using polyvinyl alcohol as a binder according to the present invention, these molds were heated at 1000°C for 30 minutes and then cooled to room temperature in a desiccator, and their residual compression strength was measured. The results obtained are shown in Table 5.

Table 5

| Mold | Residual compression strength (kg/cm$^2$) |
|---|---|
| Mold of this invention | 0 |
| $CO_2$ Mold | 30 |

As is clear from the above table, the residual compression strength of the mold of the present invention using polyvinyl alcohol as a binder was zero and its collapsibility is considered to be very good.

As explained above in detail, according to the process for regulating the hardening speed of a self-hardening mold according to the present invention, the hardening speed of the molding sand can be freely regulated and it has permitted the fabrication of a mold having a complex shape.

What is claimed is:

1. A process for regulating the hardening speed of a self-hardening mold which comprises adding 0.1 to 3 parts by weight of an aliphatic alcohol as a hardening speed regulating agent when a mold is formed with a molding sand prepared by adding 1 to 10 parts by weight of a polyvinyl alcohol solution having a concentration of 5 to 30% by weight and from 0.01 to 2.1 parts by weight of a boron compound to 100 parts by weight of refractory particles and then kneading the mixture.

2. A process according to claim 1, wherein said aliphatic alcohol is selected from the group consisting of methyl alcohol, ethyl alcohol, isopropyl alcohol, sorbitol, mannitol, ethylene glycol and glycerol.

3. A process according to claim 1, wherein from 0.1 to 2.1 parts by weight of a boron compound selected from the group consisting of manganese borate, boric acid, magnesium borate and calcium borate are added to 100 parts by weight of the refractory particles.

4. A process according to claim 1, wherein from 0.01 to 1.3 parts by weight of a boron compound selected from the group consisting of borax, sodium perborate, potassium borate, boron oxide and ammonium borate are added to 100 parts by weight of the refractory particles.

5. A process according to claim 4, wherein the boron compound added is borax and the refractory particles are silica sand.

6. A process for regulating the hardening speed of a self-hardening mold which comprises adding 0.2 part by weight of an aliphatic alcohol as a hardening speed regulating agent selected from the group consisting of sorbitol, methyl alcohol, ethylene glycol and glycerol when a mold is formed by adding 4 parts by weight of a polyvinyl alcohol solution having a concentration of 10% by weight and 1 part by weight of borax to 100 parts by weight of silica sand and then kneading the mixture.

7. A process for regulating the hardening speed of a self-hardening mold which comprises adding 0.2 to 0.8 parts by weight of glycerol as a hardening speed regulating agent when a mold is formed by adding 4 parts by weight of a polyvinyl alcohol solution having a concentration of 15% by weight and one part by weight of borax to 100 parts by weight of silica sand and then kneading the mixture.

8. A process for regulating the hardening speed of a self-hardening mold which comprises adding 4 parts by weight of an aqueous solution containing 10% by weight of polyvinyl alcohol and 5 to 35% by weight of isopropyl alcohol as a hardening speed regulating agent and 0.5 parts by weight of borax to 100 parts by weight of silica sand and then kneading the mixture.

9. A process according to claim 8, wherein said isopropyl alcohol has a concentration of 25% by weight within said aqueous solution.

10. A molding sand containing 1 to 10 parts by weight of an aqueous polyvinyl alcohol solution having a concentration of 5 to 30% by weight, 0.01 to 2.1 parts by weight of a boron compound and 0.1 to 3 parts by weight of an aliphatic alcohol as a hardening speed regulating agent per 100 parts by weight of refractory particles.

11. A molding sand according to claim 10, wherein from 0.1 to 2.1 parts by weight of a boron compound selected from the group consisting of manganese borate, boric acid, magnesium borate and calcium borate are contained therein.

12. A molding sand according to claim 10, wherein from 0.1 to 1.3 parts by weight of a boron compound selected from the group consisting of borax, sodium perborate, potassium borate, boron oxide and ammonium borate are contained therein.

13. A molding sand according to claim 12, wherein the boron compound is borax and the refractory particles are silica sand.

14. A molding sand according to claim 10, wherein said aliphatic alcohol is selected from the group consisting of methyl alcohol, ethyl alcohol, isopropyl alcohol, sorbitol, mannitol, ethylene glycol and glycerol.

* * * * *